US012709851B2

(12) United States Patent
Truex

(10) Patent No.: US 12,709,851 B2
(45) Date of Patent: Aug. 18, 2026

(54) DOCK FENDER PANEL

(71) Applicant: Anthony N. Truex, Syracuse, IN (US)

(72) Inventor: Anthony N. Truex, Syracuse, IN (US)

( * ) Notice: Subject to any disclaimer, the term of this patent is extended or adjusted under 35 U.S.C. 154(b) by 94 days.

(21) Appl. No.: 18/433,042

(22) Filed: Feb. 5, 2024

(65) Prior Publication Data

US 2025/0250756 A1 Aug. 7, 2025

(51) Int. Cl.
*E02B 3/26* (2006.01)

(52) U.S. Cl.
CPC ..... *E02B 3/26* (2013.01)

(58) Field of Classification Search
CPC ..... E02B 3/26
See application file for complete search history.

(56) References Cited

U.S. PATENT DOCUMENTS 3,449,917 A * 6/1969 Roskopf ..... E02B 3/26 293/120
3,608,882 A * 9/1971 Culp ..... B65G 69/001 267/140
3,936,040 A * 2/1976 Wilson ..... F16F 1/373 267/140
5,018,471 A * 5/1991 Stevens ..... E02B 3/26 405/211
5,027,736 A * 7/1991 Drews ..... E02B 3/26 405/215
5,031,564 A * 7/1991 Beckerer, Jr. ..... E02B 3/26 405/212

* cited by examiner

*Primary Examiner* — Janine M Kreck
(74) *Attorney, Agent, or Firm* — Crump Law P.C.

(57) ABSTRACT

The dock fender panels protect and accommodate all sizes of watercraft. The dock fender panels are thermal formed from a single sheet of polymer materials, and mount directly to the sides of docks and seawalls. The dock fender panels extend to or below the water line to enclose the sides walls of the dock. Each dock fender panel has a plurality of horizontally spaced integral "bumpers" that protrude from the panels and act as fixed fenders to protect against damage caused by the impact of watercraft across the entire height of the dock or seawall. The dock fender panels also have a plurality of openings that allow water to pass through the panels.

6 Claims, 9 Drawing Sheets

DOCK FENDER PANEL

This invention relates to dock fender panels for protecting marine craft from damage caused by contact with docks and break water barriers.

BACKGROUND AND SUMMARY OF THE INVENTION

Dock fenders or dock bumpers protect against damage caused by impacts and collisions between water craft and dock, pier and seawall as a result of wind, waves or operator error. Dock fenders are resilient structures that absorb the impact of water craft contacting the dock or seawall. Dock fenders generally take the form of vinyl covered foam pads, extruded rubber and polymer contact rails, large layered grommets, or polymer floats. Dock fenders are affixed to the dock pilings or the deck rails of the conventional dock and seawall. Dock bumpers are generally mounted horizontally to cover the length of the dock or seawall, but are normally mounted to the docks above the waterline to prevent structural deterioration, corrosion or the build up of mildew and fungus. Conventional boat docks typically service water craft of various types and sizes; however, conventional dock fenders are often not positioned or located to sufficiently accommodate smaller water craft.

The dock fender panels of this invention are designed for use on docks and seawalls to protect and accommodate all sizes of watercraft. The dock fender panels are thermal formed from a single sheet of thermoplastic elastomer, and mount directly to the sides of docks and sea walls. The dock fender panels extend to or below the water line to enclose the sides walls of the dock. Each dock fender panel has a plurality of horizontally spaced integral "bumpers" that protrude from the panels and act as fixed fenders to protect against damage caused by the impact of watercraft across the entire height of the dock or seawall. The dock fender panels also have a plurality of openings that allow water to pass through the panels. As well as providing a critical safety function, the dock fender panels provide a finished and unclutter visual appearance to the dock or seawall.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

Figure 1:
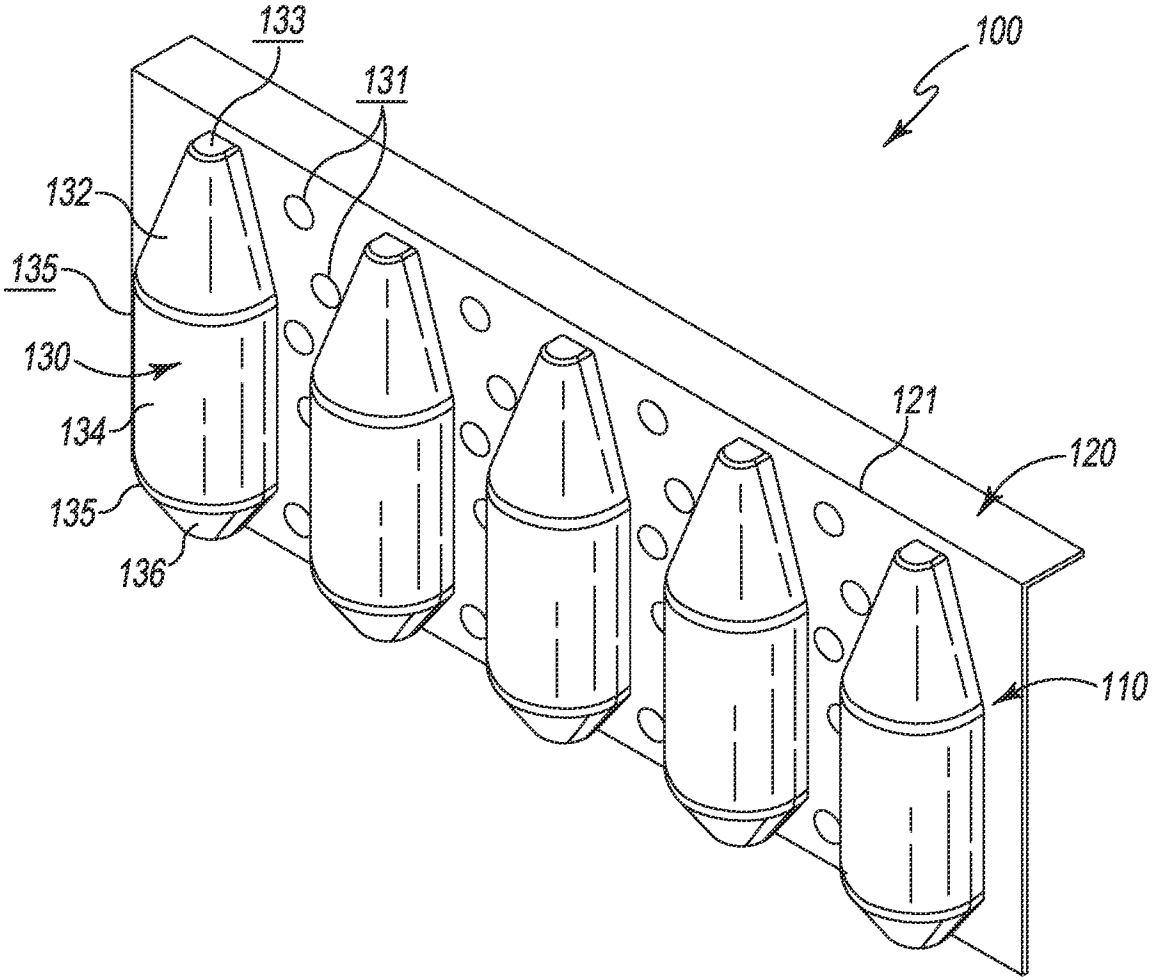
FIG. 1 is a perspective view of an exemplary embodiment of the dock fender panel of this invention.
Figure 2:
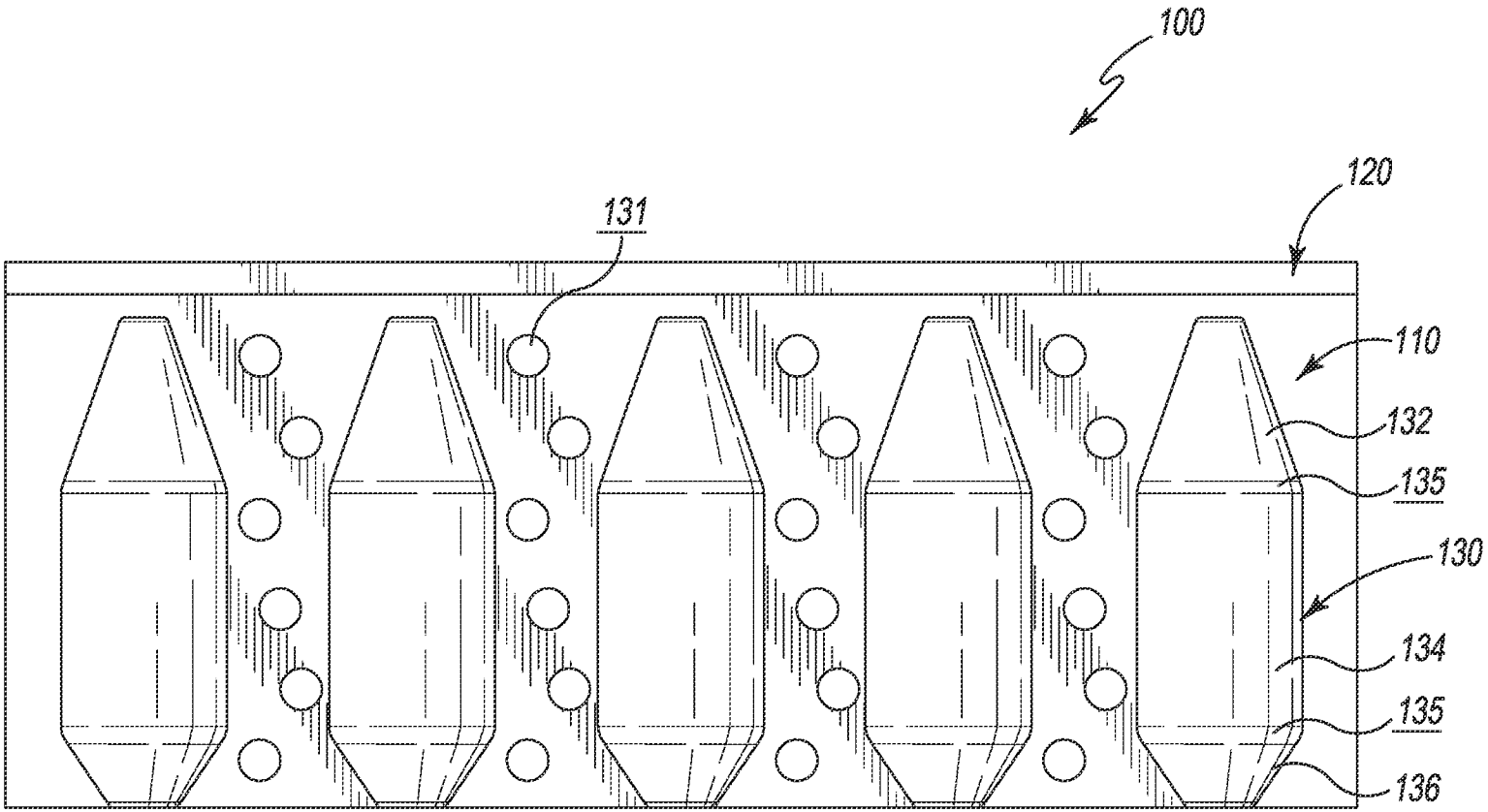
FIG. 2 is a front view of the dock fender panel of FIG. 1.
Figure 3:
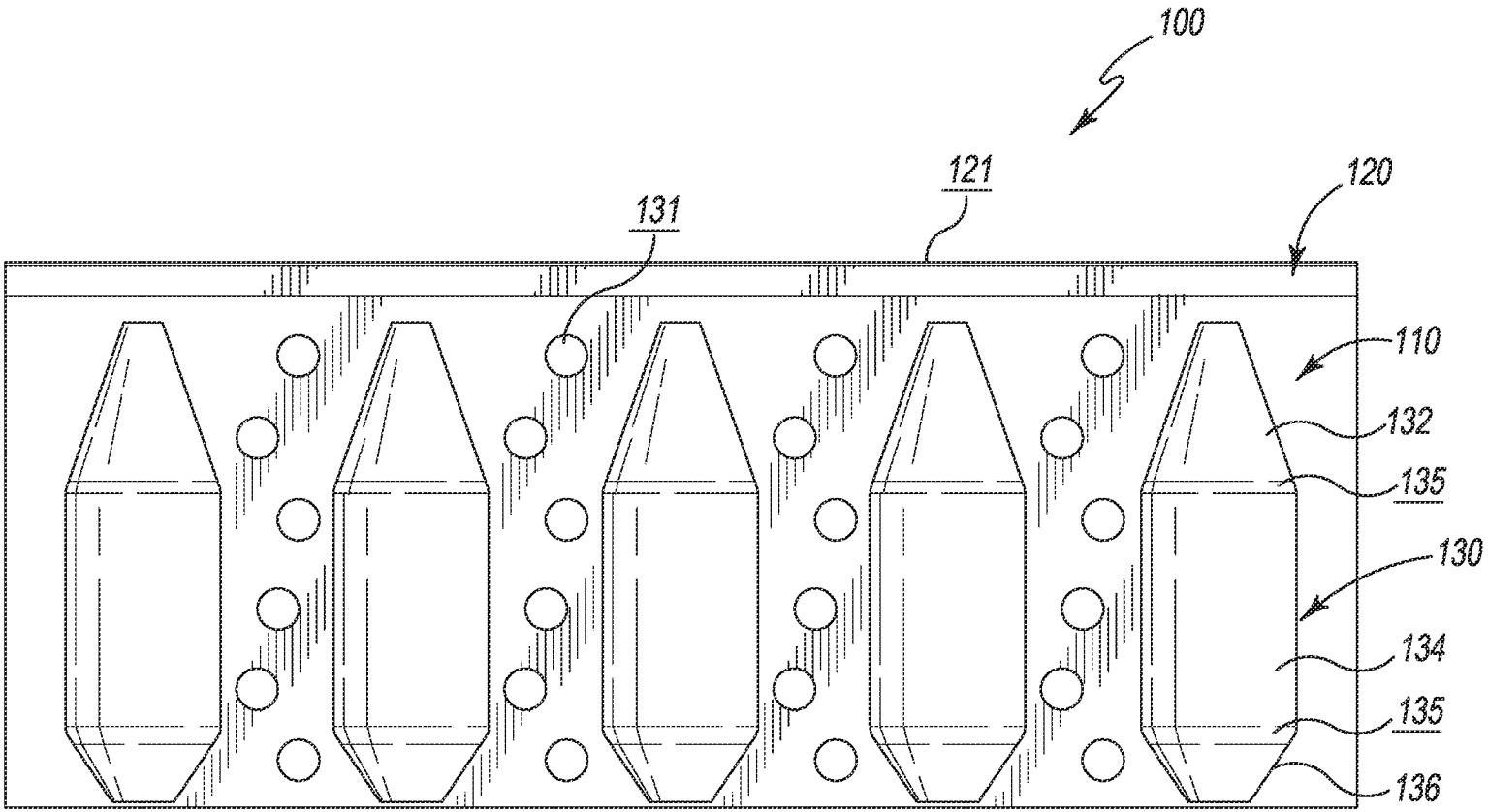
FIG. 3 is a rear view of the dock fender panel of FIG. 1.
Figure 5:
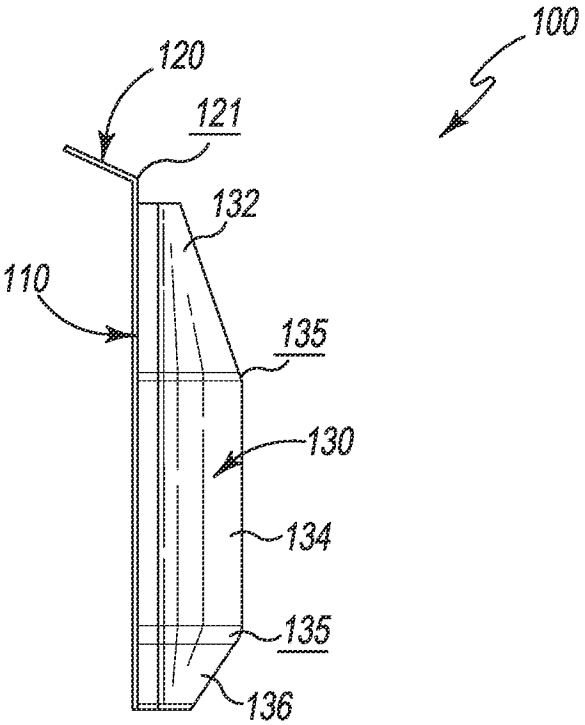
FIG. 5 is a left side view of the dock fender panel of FIG. 1.
Figure 4:
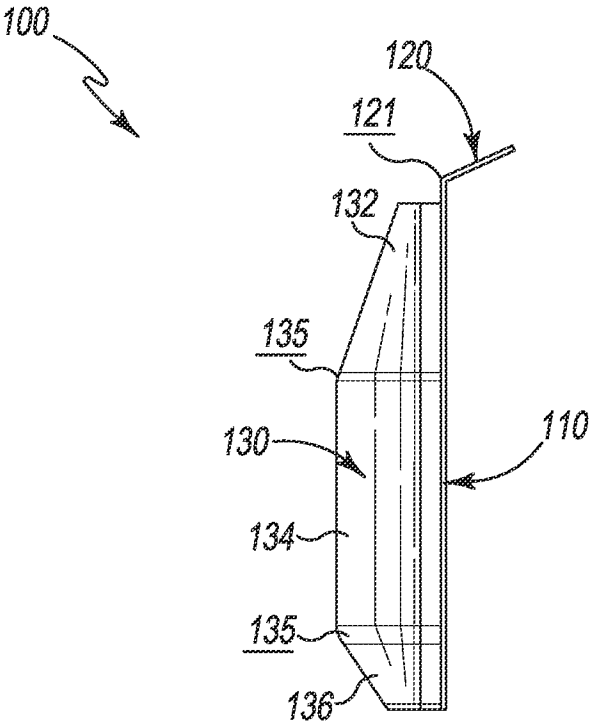
FIG. 4 is a right side view of the dock fender panel of FIG. 1.
Figure 6:
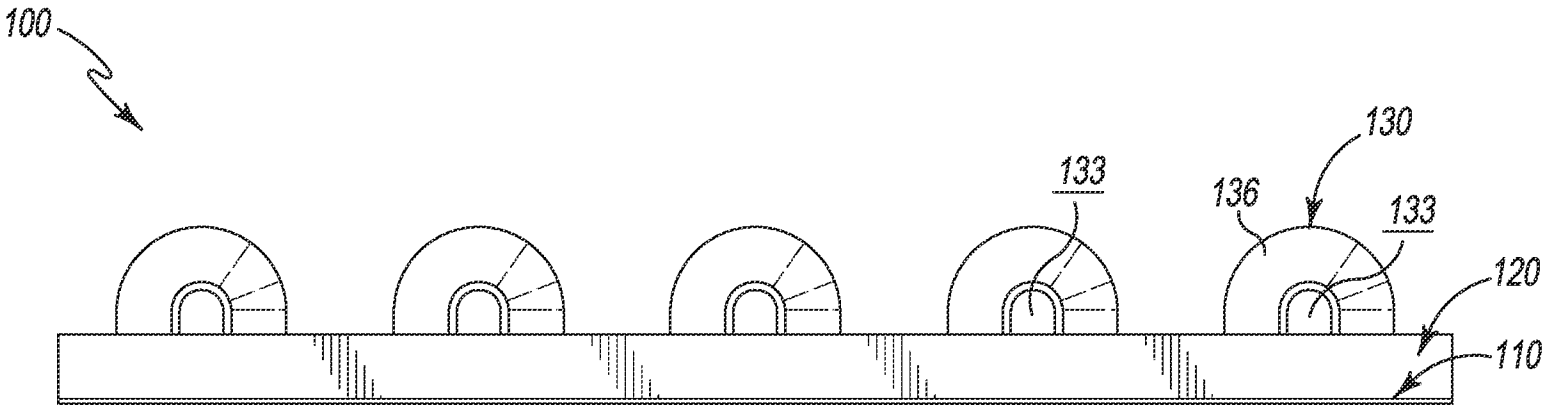
FIG. 6 is a bottom view of the dock fender panel of FIG. 1.
Figure 7:
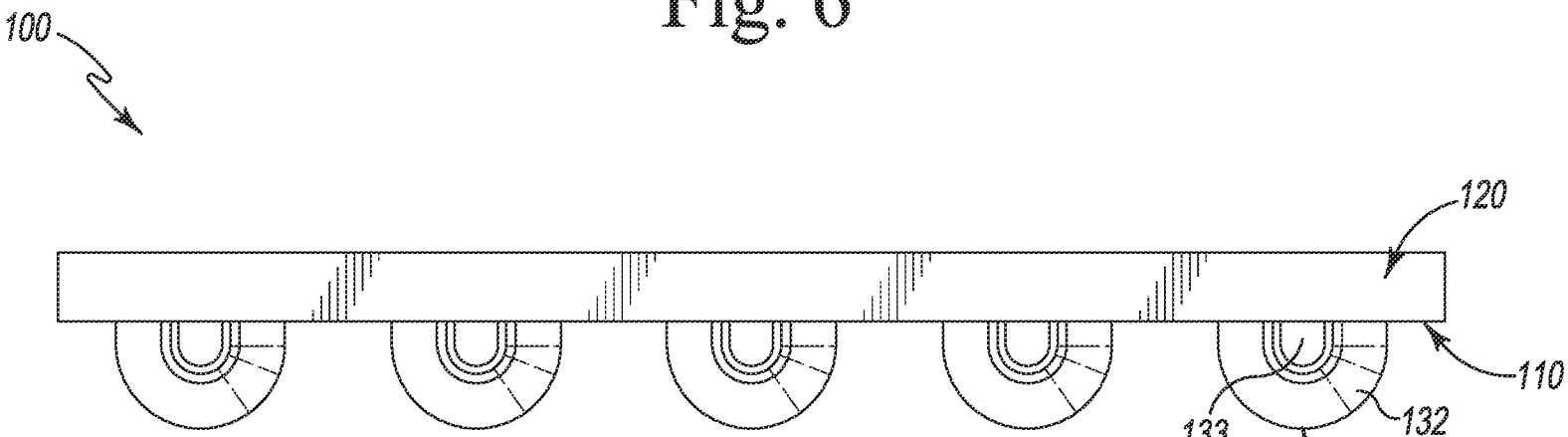
FIG. 7 is a top view of the dock fender panel of FIG. 1.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, two separate embodiments of the dock fender panels of this invention are illustrated and described herein. The dock fender panels of this invention are designed for use on docks and seawalls to protect and accommodate all sizes of watercraft. The dock fender panels mount directly to the sides of docks and extend to or below the water line to enclose the side walls of the dock or cover the sides of a seawall. Each dock fender panel has a plurality of horizontally spaced integral "bumper" protrusion that act as fixed fenders to protect against damage caused by the impact of watercraft with the dock or seawall across the entire height of the dock or seawall. The dock fender panels also have a plurality of openings that allow water to pass through the panels. In addition to providing a critical safety function, the dock fender panels provide a finished and unclutter visual appearance to the dock or seawall.

The dock fender panels are thermal formed from a single sheet of a durable, ultra-violet and algae and fungus resistant thermoplastic elastomer, such as Faraprene™ available from Primex Plastics Corporation of Richmond, Indiana. The dock fender panels are configured and dimensioned to be aligned and mounted across the length of the sidewalls of a dock or seawall. The dock fender panels extend to or below the water line to enclose the side walls of the dock. The elastomeric properties and resilience of polymer panel material allow the bumper protrusions to collapse and absorb impact without damage to the panel or the colliding structures.

FIGS. 1-10 illustrate an exemplary embodiment of the dock fender panel of this invention, which is designated generally as reference numeral 100. Dock fender panel 100 has a large flat rectangular base wall 110, an angled integral flange 120 extending the length of this top edge 120, and a plurality of raised integral bumpers 130. To accommodate various seawalls and docks with angled sidewalls relative to the deck, flange 120 is integrally connected to base wall 110 by a thin seam 121 that acts as a living hinge so that the flange can be angled relative to the base wall. Base wall 110 also has a plurality of through openings 111 located between bumpers 130 that allow water to pass through dock fender panel 100.

Bumpers 130 extend outward from base wall 110 and are spaced horizontally at equal distances across the length of dock fender panel 100. Each bumper 130 is an elongated, vertically oriented bulbous protrusion integrally formed in panel base 110. Each bumper 130 is generally symmetrical about its vertical axis and has generally a hollow semicircular lateral cross section. As shown, each bumper 130 has a conical top section 132, a cylindrical middle section 134 and a conical bottom section 136. Top section 132 and bottom section 136 have open top and bottom ends 133 (open bottom not shown) that allow water to pass through dock fender panels 100. The open ends of bottom section 136 also prevent water from collecting at the bottom of each bumper 130. Recessed channels 133 integrally connect middle section 134 and both top section 132 and bottom section 136. Recessed channels 135 assist in facilitating bumpers 130 in absorbing the impact of watercraft contacting the dock or seawall. Bumpers 130 collapse on themselves to absorb the impact of a marine craft contacting the dock or seawall. Typically, the polymer material and configuration of bumper 130 provide sufficient resiliency to allow the bumpers to return to a pre-impact shape and condition without damage to the dock, the watercraft or the dock fender panel.

Figure 8:
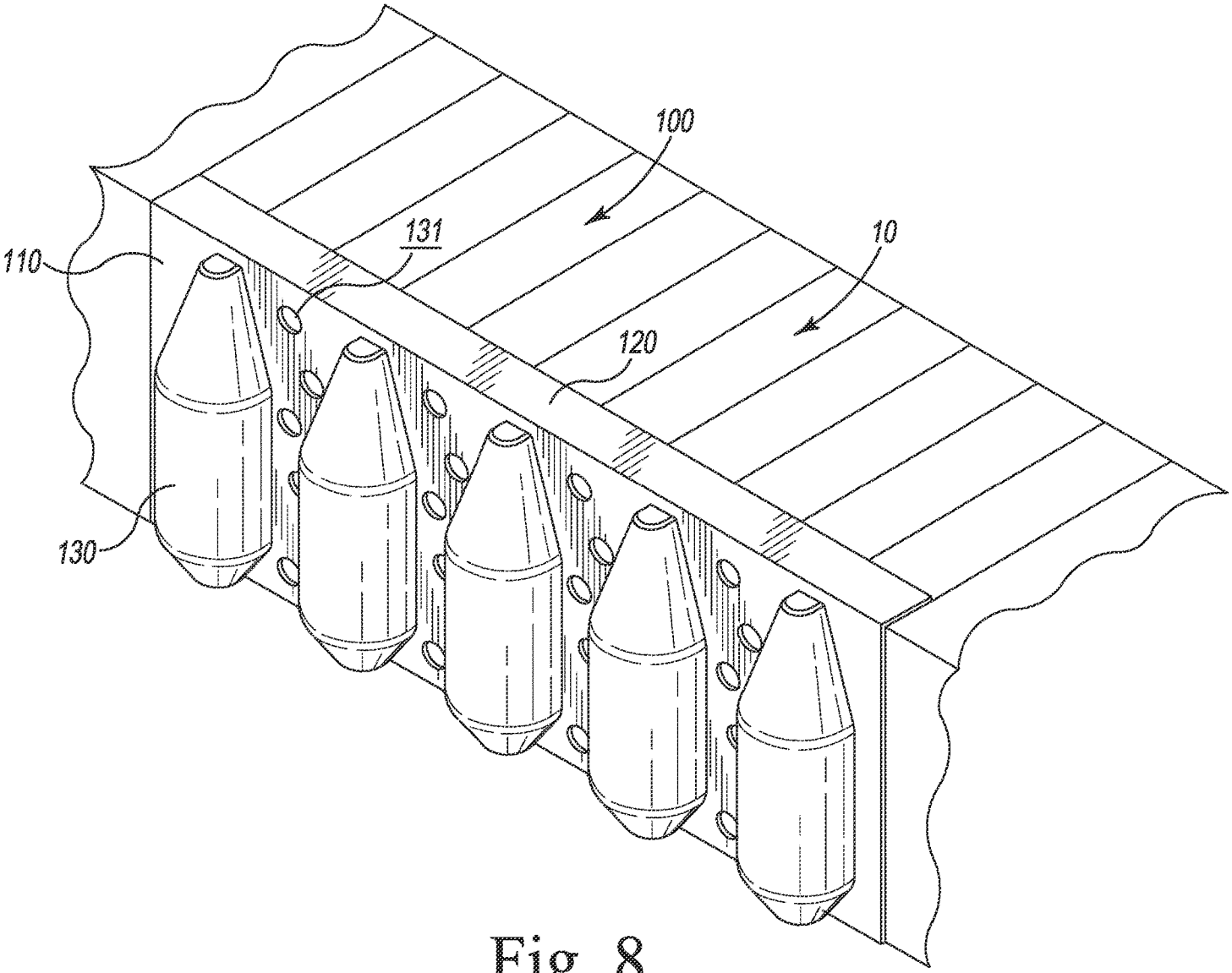
FIG. 8 is a perspective view of the dock fender panel of FIG. 1 mounted to a conventional dock.
Figure 9:
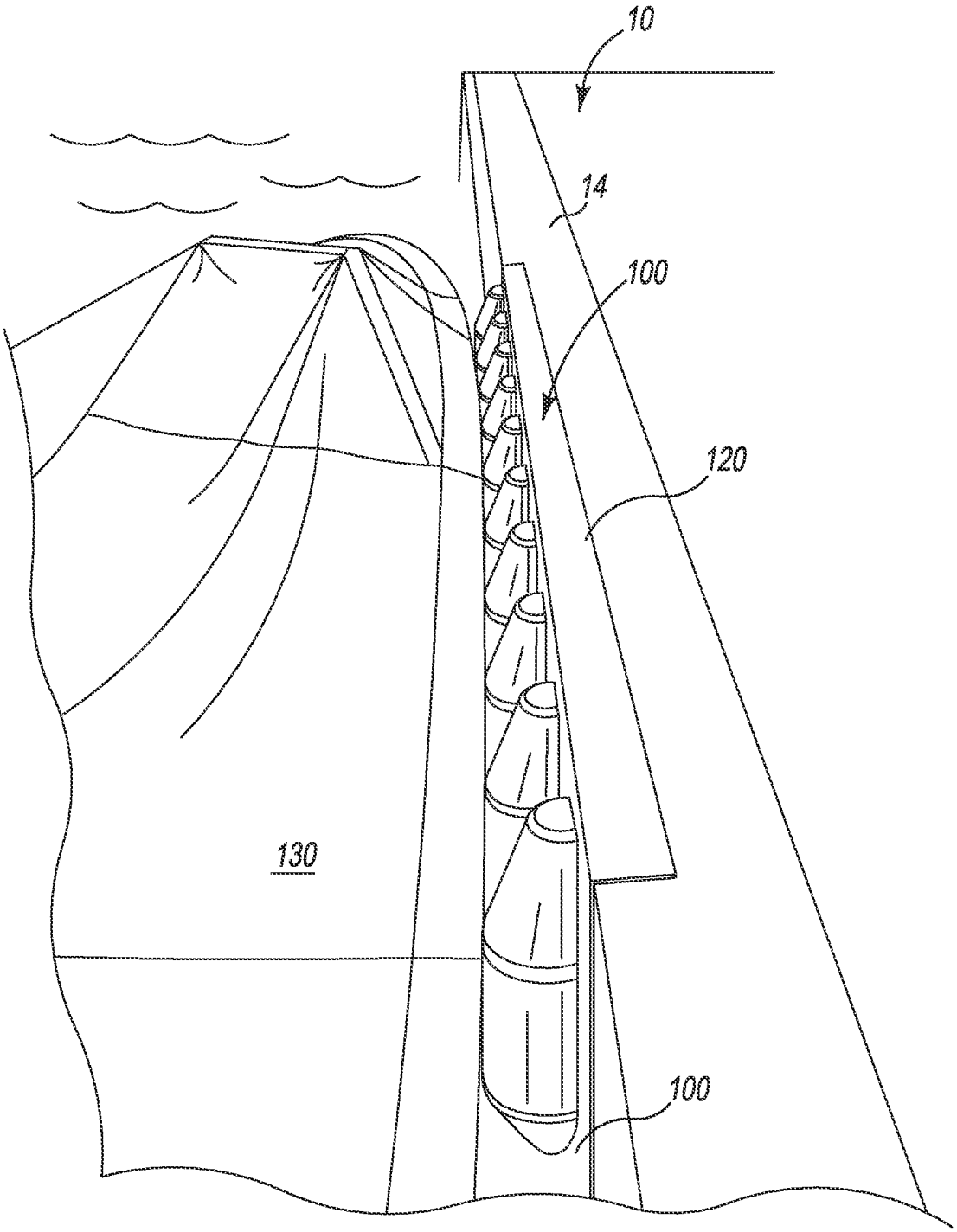
FIG. 9 is another perspective view of the dock fender panel of FIG. 1 mounted to a conventional dock.
Figure 10:
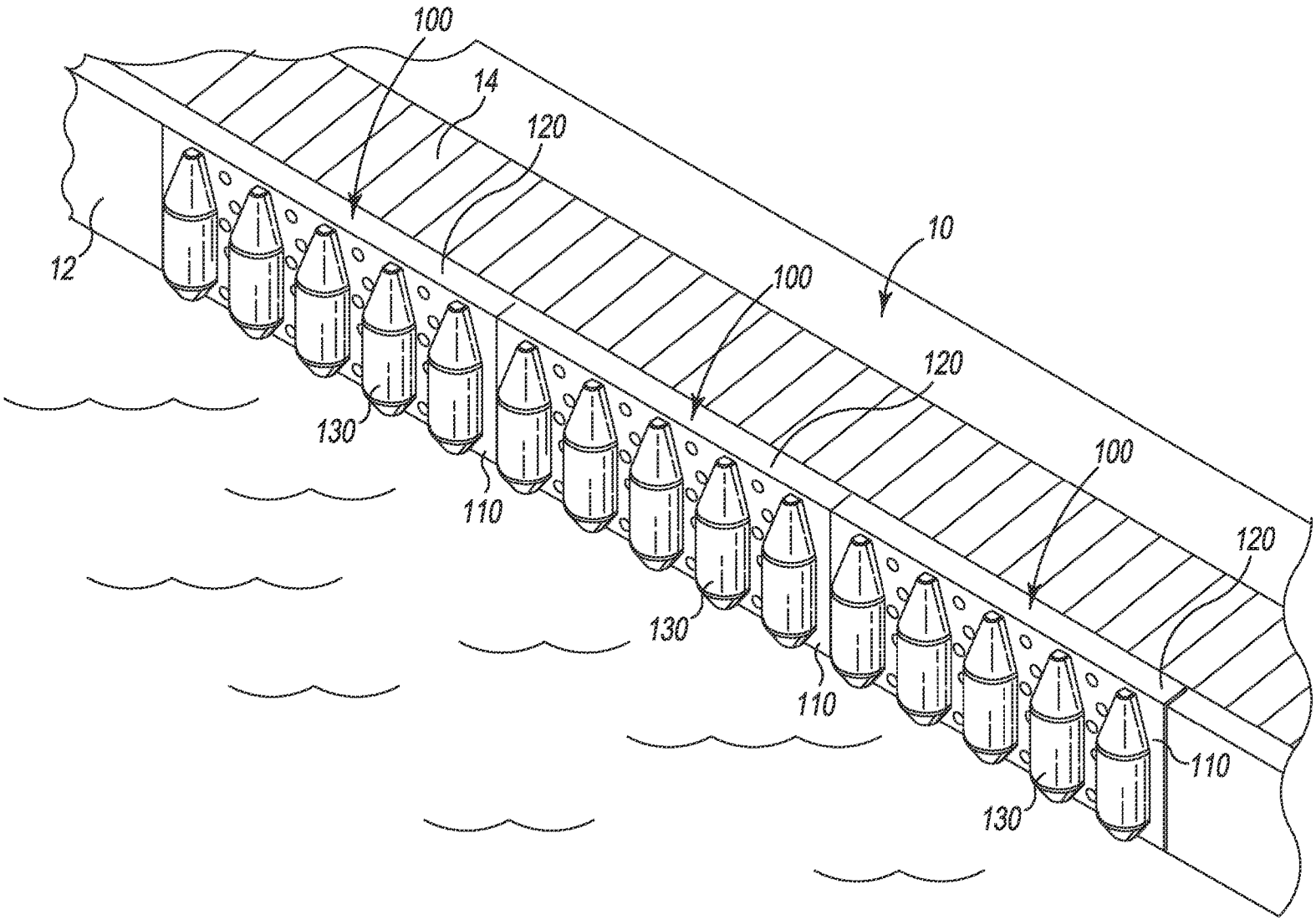
FIG. 10 is a perspective view of multiple dock fender panels of FIG. 1 mounted to a conventional dock.

As shown in FIGS. 8-10, dock fender panels 100 mounts directly to the side rails using screw fasteners or other suitable methods. Dock fender panels 100 are dimensioned to be approximately 24" tall and 66" in length, although, panel dimensions may change as necessary for each dock or seawall. Fasteners are driven through panel flange 120 into the top of the dock rail or decking. Additional fasteners can be driven through the top edge of panel base 110 into the dock rail. Dock fender panels 100 can be secured to dock piles using, fasteners, wires, zip ties and other means as necessary to secure base panel to the sides of the dock or seawall.

Figure 11:
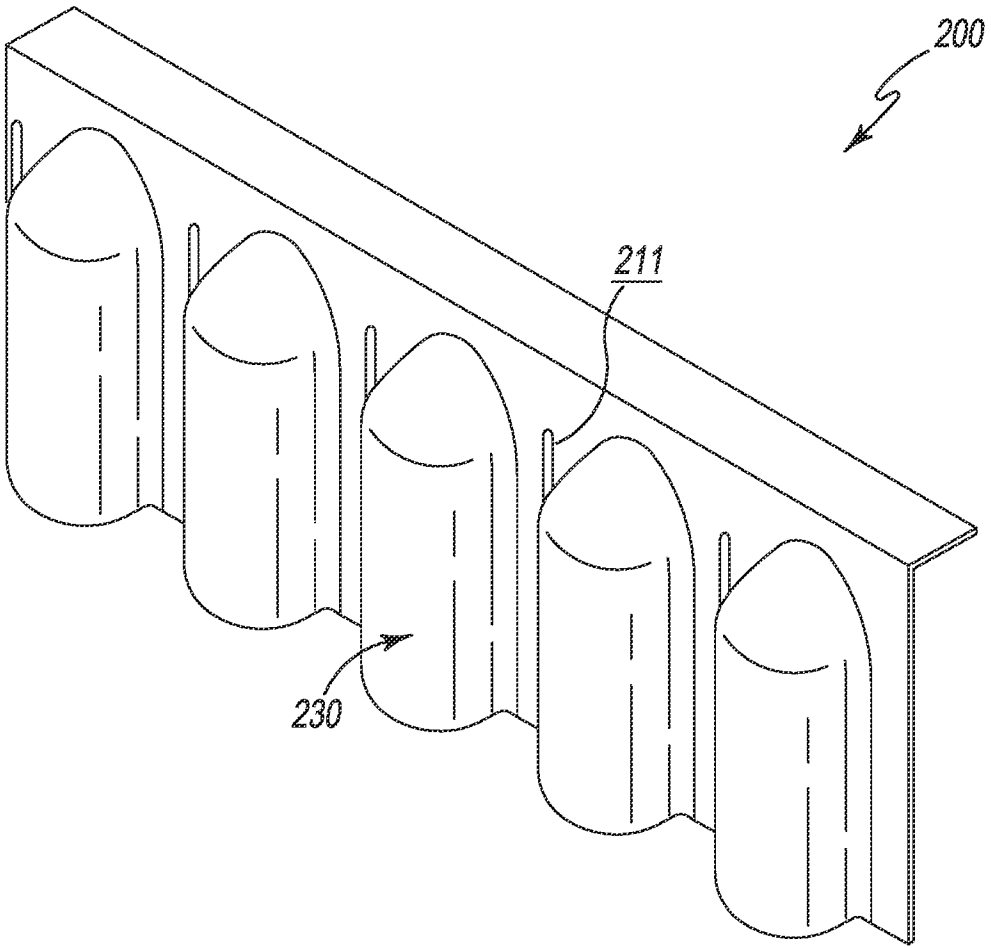
FIG. 11 is a perspective view of a second exemplary embodiment of the dock fender panel of this invention.

FIG. 11 illustrates a second exemplary embodiment of the dock fender panels of this inventions, which is designated generally as reference number 200. Dock fender panel 200 is similar to panel 100 in function and construction, but differs in the shape and configuration of panel openings 211 and bumpers 230 and panel openings 211. As shown, panel openings 211 are vertical slots and bumpers 230 are bulbous ovals.

It is understood that the above description does not limit the invention to the details given, but may be modified within the scope of the following claims.

I claim:

1. A dock fender panel comprising:

a planar base wall adapted to mount to a side of a dock or seawall, the base wall formed from a thin resilient polymer material, the base wall having a plurality of elongated protrusions integrally extending outwardly therefrom and configured to absorb the impact of watercraft against the dock fender panel, each of the plurality of integral protrusions being elongated and vertically oriented and horizontally spaced across the length of the planar base wall, each of the plurality of integral protrusions also has a conical top section, a cylindrical middle section and a conical bottom section separated by an integral recessed channel thereof.

2. The dock fender panel of claim 1 wherein the base wall has an integral flange extending along a top edge of the base wall and adapted to affix to the dock or seawall.

3. The dock fender panel of claim 1 wherein the base wall has a plurality of openings to allow water to pass through the base wall.

4. The dock fender panel of claim 1 wherein each of the plurality of integral protrusions is substantially symmetrical about its vertical axis and has a hollow semicircular lateral cross section.

5. The dock fender panel of claim 1 wherein each of the plurality of integral protrusions has open ends that allow water to pass through the dock fender panel.

6. A dock fender panel comprising:

a planar base wall adapted to mount to a side of a dock or seawall, the base wall formed from a thin resilient polymer material, the base wall having a plurality of elongated protrusions integrally extending outwardly therefrom and configured to absorb the impact of watercraft against the dock fender panel, each of the plurality of integral protrusions being elongated and vertically oriented and horizontally spaced across the length of the planar base wall, each of the plurality of integral protrusions also has open ends that allow water to pass through the dock fender panel.

* * * * *